US005682613A

United States Patent [19]

Dinatale

[11] Patent Number: 5,682,613

[45] Date of Patent: Nov. 4, 1997

[54] WATERPROOF BREATHABLE GLOVES

[75] Inventor: Chuck Dinatale, Gloversville, N.Y.

[73] Assignee: Gates-Mills, Inc., Johnstown, N.Y.

[21] Appl. No.: 279,958

[22] Filed: Jul. 25, 1994

[51] Int. Cl.[6] ..... A41D 19/00

[52] U.S. Cl. ..... 2/168; 2/161.8; 2/161.5; 428/138

[58] Field of Search ..... 2/159, 161.1, 161.5, 2/161.6, 161.7, 161.8, 167, 168, 169, 2, 131, 137, 138

[56] References Cited

U.S. PATENT DOCUMENTS

| | | | |
|---|---|---|---|
| 1,725,065 | 8/1929 | Edwards | 2/168 |
| 2,060,961 | 11/1936 | Tillotson | 2/168 |
| 3,050,738 | 8/1962 | Rytina | 2/162 |
| 3,173,150 | 3/1965 | Mohler | 2/167 |
| 3,945,049 | 3/1976 | Barlow | 2/167 |
| 4,303,712 | 12/1981 | Woodroof . | |
| 4,359,783 | 11/1982 | Andrews . | |
| 4,439,473 | 3/1984 | Lippman . | |
| 4,494,246 | 1/1985 | Tillbrook . | |
| 4,497,072 | 2/1985 | Watanabe | 2/168 |
| 4,819,345 | 4/1989 | Mulcahy . | |
| 4,828,556 | 5/1989 | Braun . | |
| 4,863,788 | 9/1989 | Bellairs . | |
| 4,912,860 | 4/1990 | Keller . | |
| 5,010,596 | 4/1991 | Brown . | |
| 5,027,438 | 7/1991 | Schwarze . | |
| 5,032,450 | 7/1991 | Rechlicz . | |
| 5,036,551 | 8/1991 | Dailey . | |
| 5,168,576 | 12/1992 | Krent et al. | 2/2 |
| 5,203,793 | 4/1993 | Lyden . | |
| 5,253,434 | 10/1993 | Curley . | |
| 5,269,079 | 12/1993 | Kunstadt . | |

*Primary Examiner*—C. D. Crowder
*Assistant Examiner*—Larry D. Worrell, Jr.
*Attorney, Agent, or Firm*—Schmeiser, Olsen & Watts

[57] ABSTRACT

Waterproof, breathable gloves and a method of making the gloves are disclosed herein. The gloves are preferably used in cold weather applications such as fishing or hunting. The glove includes a laminate of a porous elastomeric material, a fabric layer, and a waterproof breathable film. A nonporous textured gripping surface provide feel and grip so that the gloves need not be removed when doing activities such as hunting.

12 Claims, 3 Drawing Sheets

WATERPROOF BREATHABLE GLOVES

FIELD OF THE INVENTION

The present invention relates generally to apparel and related articles. In particular, the present invention is concerned with waterproof, breathable gloves having cold weather applications such as fishing or hunting.

BACKGROUND OF THE INVENTION

In the past, gloves made of elastomeric material such as neoprene rubber have been used for cold weather fishing or hunting. One of the difficulties with gloves made of solid neoprene rubber is that they tend to trap moisture inside the glove and do not breathe thus resulting in a "clammy" and tingling sensation of the hand. After prolonged periods of use of the neoprene rubber gloves, the hand begins to lose sensation.

The popularity of neoprene rubber gloves derives from the advantage that they offer a good feel when gripping objects such as a trigger during hunting or utilizing a fishing pole during cold weather. Other types of gloves that would offer a good feel when gripping objects are generally too thin to provide adequate insulation. Increasing the thickness of the material to provide adequate insulation results in the loss of feel when gripping objects. Thus, arises the need for a glove with a good grip and feel while not having the disadvantage of the neoprene rubber gloves.

Other patents such as U.S. Pat. No. 5,010,596 to Brown et al. address the problem of trapping moisture in a garment for physical conditioning. The garment of U.S. Pat. No. 5,010,596 is constructed of a flexible stretchable material for hugging the thighs of the wearer. The flexible material is perferably comprised of a laminated neoprene core having inner and outer surfaces respectively faced with an inner layer of nylon and an outer layer of lycra or nylon fabric. Flexible stretchable material is preferably perforated throughout a multiplicity of small perforations to allow dissipation and evaporation of perspiration. The neoprene core is perforated to provide ventilation for heat and perspiration dissipation.

U.S. Pat. No. 4,912,860 to Keller discloses a dual-height wader. The wader is constructed of any of a number of durable, natural or synthetic, waterproof materials or combinations of materials. A semi-elastic or elastic material such as a foam neoprene and most preferably nylon-lined or spandex-lined foam neoprene is used to construct the wader.

U.S. Pat. No. 4,303,712 to Woodroof discloses a fabric elastomer composite having a relatively thin elastomer membrane with a stretchable fabric joined thereto. The composite is thin, lightweight, waterproof but vapor permeable, and stretchable at least 100% in each direction.

U.S. Pat. No. 5,027,438 to Schwarze et al. discloses operating room clothing with coated fabric. The operating room clothing includes a barrier panel. The barrier panel is composed of a bacteriostatically-treated polyester/cotton fabric sandwiched between a pair of water repellent, microporous urethane-coated fabrics or high-density woven fabrics, the composite being stitched together.

U.S. Pat. No. 4,863,788 to Bellairs et al. discloses a waterproof, breathable microporous membrane with cellular foam adhesive. The breathable, waterproof fabric includes a fabric substrate first coated with an adhesive foam formed from a fully reacted polymer such as polyvinyl chloride, polyurethane, acrylic, polystyrene or mixtures thereof. A microporous membrane structure is formed upon the adhesive foam from thermoplastic polymers. The microporous membrane provides the coated fabric with the properties of waterproofness and breathability. A continuous film formed from acrylic, polyvinyl chloride or polyurethane latex, is coated on the surface of the microporous layer.

U.S. Pat. No. 4,828,556 to Braun et al. discloses a breathable, multilayered, clothlike barrier, i.e., a structure which is substantially impervious to liquid water but permeable by water vapor.

Other patents which disclose laminates having a waterproof outer coatings include U.S. Pat. No. 4,439,473 to Lippman; U.S. Pat. No. 5,036,551 to Dailey et al., and U.S. Pat. No. 5,032,450 to Rechlics et al.

The above related art summaries are merely representative of portions of the invention disclosed in each reference. In no instance should these summaries substitute for a thorough reading of each individual reference.

One of the difficulties with using material laminates of the above related art, such as that disclosed in U.S. Pat. No. 5,010,596, with the outdoor glove of the present invention is that the exterior waterproof, breathable layer does not offer a good grip. Other difficulties encountered in arriving at the present invention include: forming a laminate that adheres to an elastomeric core that will not have adhesive which negates the breathability of the waterproof, breathable material; and developing a waterproof, breathable material that would stretch with an elastomeric material such that the material does not lose the characteristic of being waterproof.

A further difficulty in arriving at the present invention is retaining the gloves' waterproof characteristic at the seams. Conventional seams are sewn entirely through the material. However, in the case of the present invention, doing so would allow water to penetrate therethrough.

SUMMARY OF THE INVENTION

The present invention includes a method for making a waterproof, breathable gloves as well as the gloves produced by the method. The gloves of the present invention are designed for applications such as hunting or fishing which require a water barrier and insulation, yet offer the user a good grip so that the gloves need not be removed. The present invention offers the advantage of neoprene material for such applications while overcoming the disadvantage of not allowing the user's hand to get "clammy" or "tingly" after lengthy use.

An advantage of the present invention is that the neoprene core is exposed on the gripping surface of the hand so that the user may have an adequate grip when handling or manipulating objects such as the trigger of a gun. The gripping surface offers a good feel as well as a non-slip surface for the user.

During manufacturing the gloves of the present invention, a dry adhesive is used rather than a wet adhesive. This overcomes the problem of clogging the waterproof, breathable material thus rendering the material nonbreathable. The dry adhesive is activated by pressure and friction, preferably, by a drum roller during the lamination process.

The elastomeric core material has holes formed therein prior to formation of the laminate. During manufacture of the gloves, seams are sewn in the laminate with a special machine that will only penetrate partially through the laminate. If the seam were to penetrate the laminate, the glove would lose its waterproof characteristics.

DETAILED DESCRIPTION OF THE PREFERRED EMBODIMENTS

Figure 1:
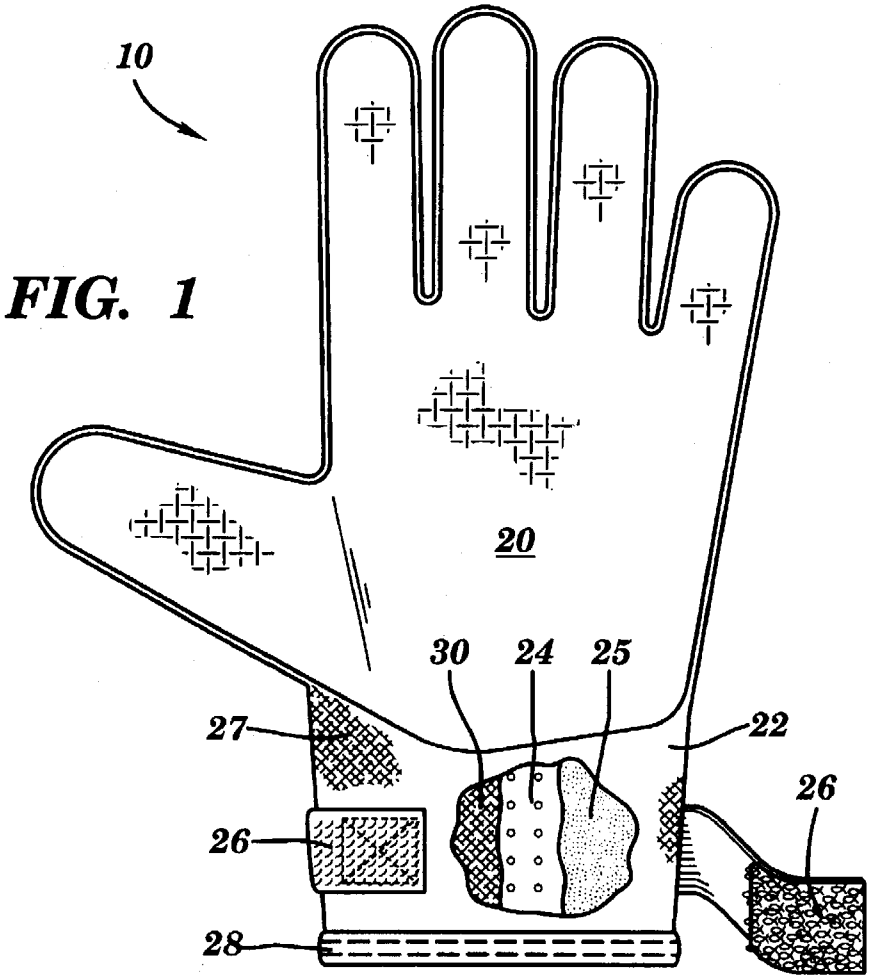
FIG. 1 is a perspective view of the palm of the glove of the present invention.

FIG. 1 shows the palm side of a glove 10 of the present invention. The glove 10 includes an elastomeric grip surface 20 for offering the user a good feel and grip, as well as providing adequate insulation when using the glove. The elastomeric grip surface 20 is nonporous such that water may not enter into the interior of the glove 10 and the grip surface 20 retains its waterproof characteristics. Surrounding the nonporous elastomeric grip surface 20 is a fabric exterior 22, preferably made from a thermoplastic polyamide (nylon). The fabric exterior 22 is laminated to a waterproof, breathable film 25, preferably VAPEX, a monolithic hydrophilic polyurethane copolymer. The laminate comprising exterior 22 and film 25 is then laminated to a porous elastomeric core 24, preferably neoprene, and a fabric interior 30, preferably made from a thermoplastic polyamide (nylon). On the wrist portion 27 of the glove 10 is a flexible wrist band 28 made of elastic material for giving a tight insulating conformance around the user's wrist. Proximate the flexible wrist band 28 is a VELCRO® hook and loop fastener wrist strap 26. The wrist strap 26 provides further conformance of the wrist portion of the glove 27 to the user's wrist. The wrist strap 26 is used to tighten the wrist portion of the glove 10 to the user such that insulating properties will not be lost or material such as snow or dirt may not enter into the interior of the glove 10.

Figure 2:
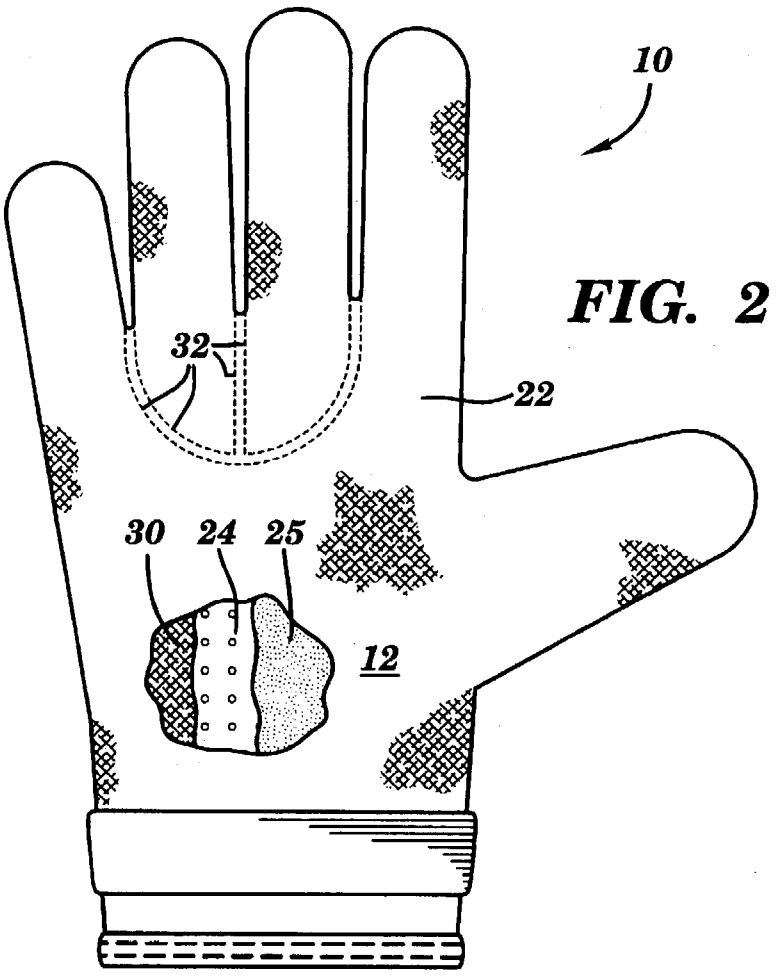
FIG. 2 is a plan view of a back of the glove of the present invention.

FIG. 2 shows the back 12 of the glove 10. The back includes the laminate described in FIG. I which comprises a fabric exterior 22, a waterproof, breathable material 25, a porous elastomeric material 24, and a fabric interior 30. The back of the glove 10 offers the maximum breathing of the hand because a grip surface 20 is not required.

Figure 3:
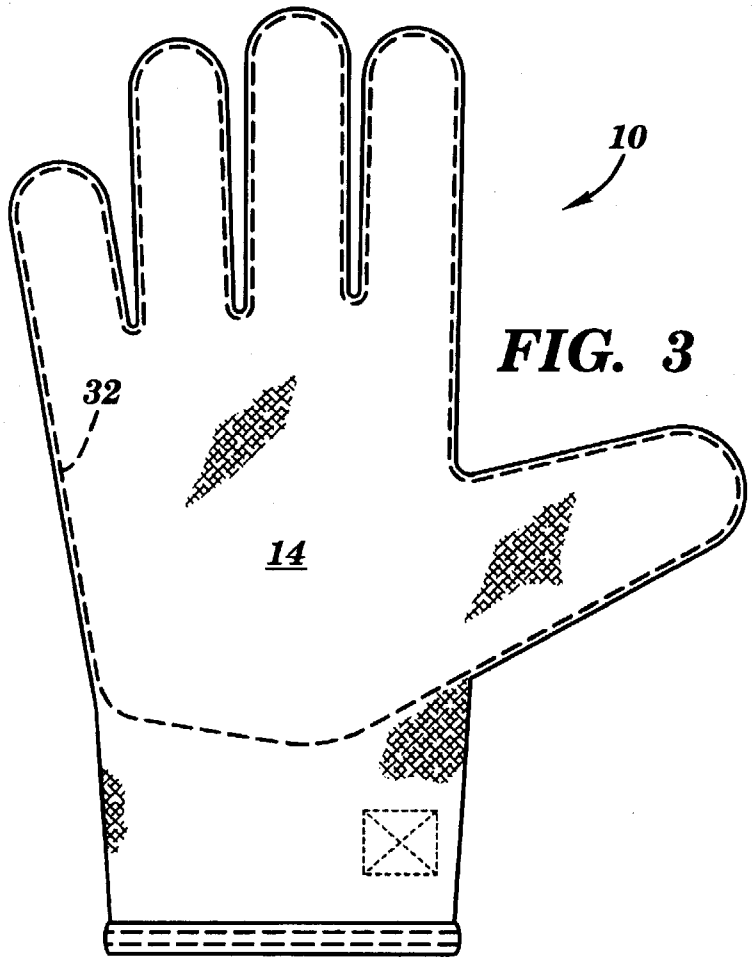
FIG. 3 is a view of an interior of the glove of the present invention.

An interior 14 of the glove 10 is shown in FIG. 3. The interior 14 includes stitches 32 for the grip surface 20. The stitches 32 do not extend entirely through the the laminates 40, 50 of the glove 10. If the stitches 32 did extend through to the laminates 40, 50, the stitches 32 would have holes therethrough which would allow the passage of water.

Figure 4:
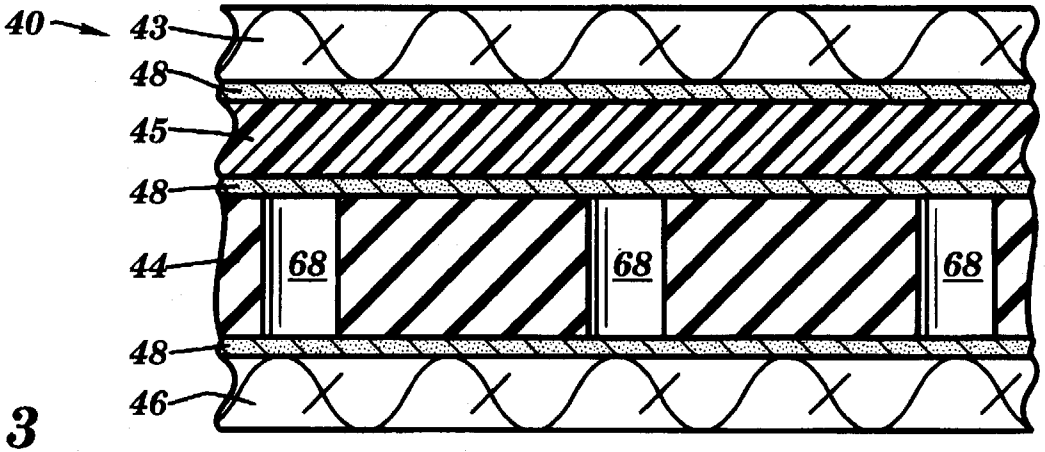
FIG. 4 is a cutaway view of the porous laminate material of the present invention.

A porous laminate portion 40 is shown in FIG. 4. The porous laminate portion 40 of the glove 10 includes an outer layer 43 of fabric material, preferably a thermoplastic polyamide. The outer layer 43 is laminated to a waterproof, breathable material 45, preferably VAPEX, by a dry adhesive 48. The VAPEX material was selected because it can stretch with the porous elastomeric core 44 without loosing its waterproof or windproof characteristics. The porous elastomeric core 44 is preferably made of a neoprene rubber and is adhered to the waterproof, breathable material 45 by dry adhesive 48. The porous elastomeric core 44 has 1/16 inch holes 68 punched therethrough by a die press at 1/4 inch spacings. The interior layer 46 is a fabric material is attached by dry adhesive 48.

Figure 5:
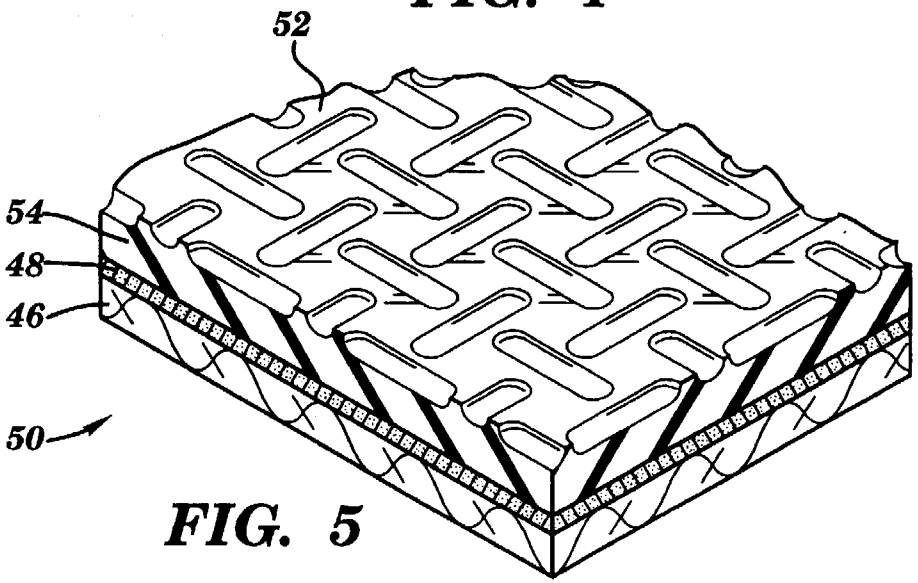
FIG. 5 is a cutaway view of the nonporous laminate portion of the present invention.

FIG. 5 discloses a nonporous laminate portion 50. The nonporous laminate portion 50 does not include outer layer 43 or waterproof, breathable material 45. The nonporous laminate portion 50 has a textured outer surface 52 to offer a good grip to the user. The inner layer 46 is attached to the elastomeric core 54 by a dry adhesive 48.

Figure 6:
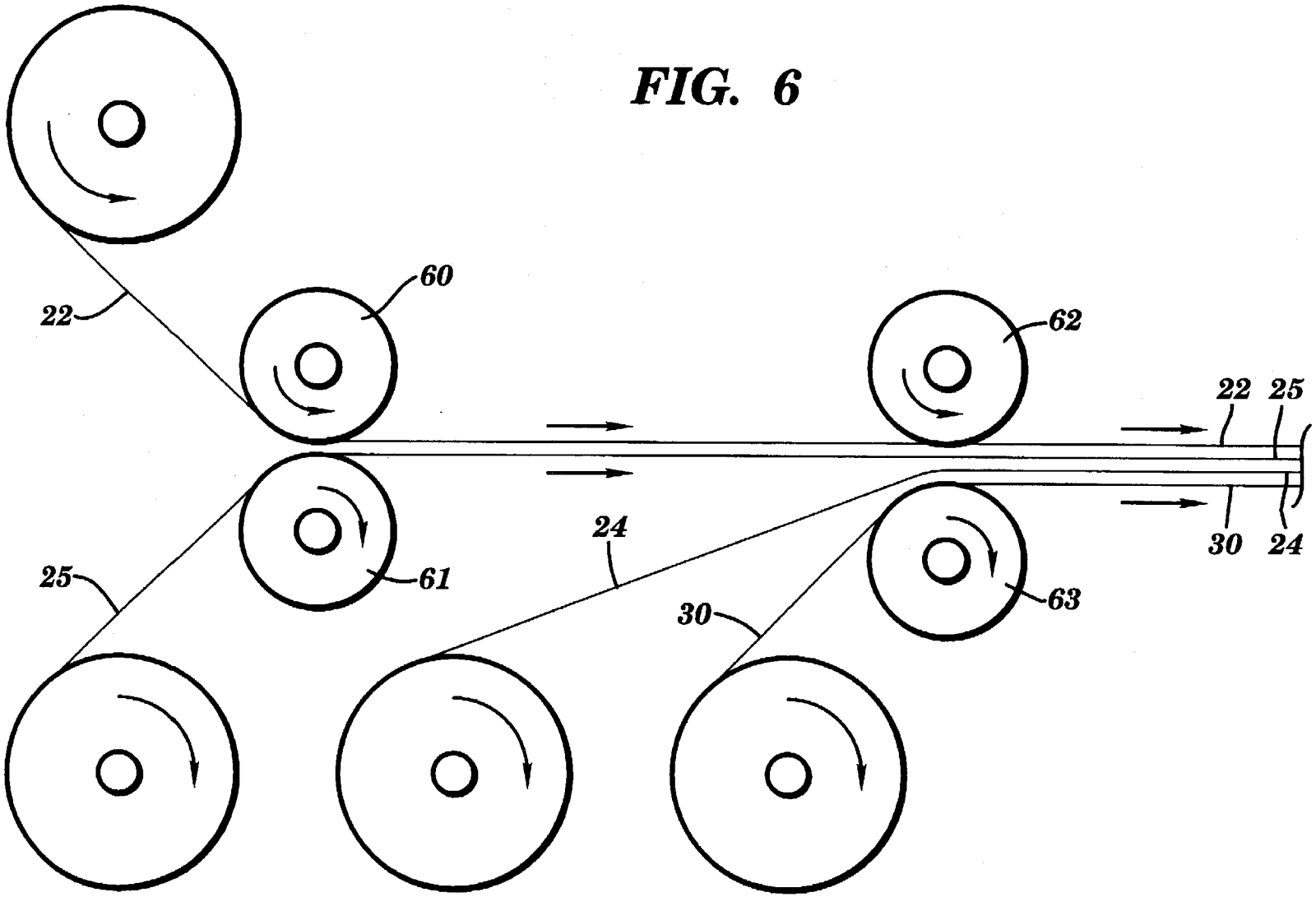
FIG. 6 shows the manufacture of the laminate of the present invention.

With reference to FIG. 6, the process of forming the porous laminate portion 40 is shown. Dry adhesive 48 (not shown) is applied between outer fabric layer 22 and a waterproof, breathable material or film 25. The dry adhesive between layers 22 and film 25 are then activated by pressure and friction from pressure rollers 61, 60. Next, a porous elastomeric material 24 and a fabric layer 30 are provided. The porous elastomeric material 24 includes 1/16 inch holes punched therein. A dry adhesive 48 is applied between both film 25 and the porous elastomeric material 24 as well as between porous elastomeric material 24 and fabric layer 30. The dry adhesive 48 between layers 25, 24, 30 is then activated by pressure rollers 62, 63 to form porous laminate 40. A wet adhesive is not used because it tends to clog the laminate.

The porous laminate 40 and the nonporous laminate 50 are then cut in patterns and sewn together at seam 32 (See FIG. 3). Seam 32 only penetrates part way through the material and a quick bonding adhesive is used to fill the seam 32.

The embodiments disclosed herein have been discussed for the purpose of familiarizing the reader with the novel aspects of the invention. Although preferred embodiments of the invention have been shown, many changes, modifications and substitutions may be made by one having ordinary skill in the art without necessarily departing from the spirit and scope of the invention as described in the following claims.

I claim:

1. A glove comprising:

a first portion having a laminate including: a porous elastomeric material, and a material having resistance to wind and liquid water while providing water vapor transport; and a second portion having a layer of non-porous elastomeric material, wherein the layer of non-porous elastomeric material is an outer layer of the second portion of the glove, and wherein the non-porous and porous elastomeric materials are neoprene rubber.

2. The glove of claim 1, wherein the first portion laminate further includes:

an outer layer of fabric material.

3. The glove of claim 1, wherein the second portion made of the elastomeric material is a gripping surface of the glove.

4. The glove of claim 1, wherein the material having resistance to wind and liquid water while providing water vapor transport is a monolithic hydrophilic polyurethane copolymer.

5. A glove comprising:

a first laminate being a first portion of the glove including: a first inner layer and a second outer layer, both made of a first material construction; a third layer, proximate said first inner layer, made of a second material construction of porous elastomeric material; and a fourth layer, proximate said third layer and said second outer layer, made of a third material construction of material having resistance to wind and liquid water while providing water vapor transport; and a second laminate being a second surface portion of said glove including: an inner layer of said first material construction; and an outer layer of a fourth material construction of nonporous elastomeric material.

6. The glove of claim 5, wherein the first and second laminates are adhered together by a stitching that does not extend entirely through the first and second laminates.

7. The glove of claim 1, wherein the first portion and the second portion are adhered together.

8. The glove of claim 7, wherein the first portion and the second portion are adhered by stitching, thereby forming a seam, wherein said stitching only extends through a portion of the laminate of the first portion.

9. The glove of claim 8, wherein the seam is filled with an adhesive.

10. The glove of claim 1, wherein the porous elastomeric material is neoprene rubber having die-cut holes therethough.

11. A glove comprising: a first portion having a laminate including: a porous elastomeric material, and a material having resistance to wind and liquid water while providing water vapor transport; and a second portion having a layer of non-porous elastomeric material, wherein the layer of non-porous elastomeric material is an outer layer of the second portion of the glove and wherein the first portion further comprises a first piece cut according to a first pattern, a second piece cut according to a second pattern, and a third piece cut according to a third pattern, and wherein the second portion is cut according to a fourth pattern, each piece and portion being adhered to the corresponding pieces and portions to form the glove shape.

12. The glove of claim 11, wherein the pieces and portions are adhered by stitching, thereby forming seams, wherein said stitching only extends through a portion of the laminate of the first portion.

* * * * *